US006585344B2

(12) United States Patent
Kolodziej

(10) Patent No.: US 6,585,344 B2
(45) Date of Patent: Jul. 1, 2003

(54) SYSTEMS AND METHODS FOR AUTOMATICALLY DETECTING A NUMBER OF REMAINING SHEETS OF PRINT MEDIA

(75) Inventor: Ryan H. Kolodziej, Nampa, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/816,045

(22) Filed: Mar. 22, 2001

(65) Prior Publication Data

US 2002/0135628 A1 Sep. 26, 2002

(51) Int. Cl.[7] ..... B41J 29/393; B41J 29/44

(52) U.S. Cl. ..... 347/19; 250/559.27; 271/265.04; 399/23

(58) Field of Search ..... 347/8, 19, 104; 271/110, 265.04; 399/23, 389; 400/708; 250/559.27, 559.28

(56) References Cited

U.S. PATENT DOCUMENTS

| | | | | | |
|---|---|---|---|---|---|
| 4,107,606 | A | * | 8/1978 | Typpo et al. | 324/229 |
| 4,535,463 | A | * | 8/1985 | Ito et al. | 377/8 |
| 4,566,547 | A | * | 1/1986 | Furukawa | 177/46 |
| 4,748,479 | A | * | 5/1988 | Ohira et al. | 355/72 |
| 4,835,573 | A | * | 5/1989 | Rohrer et al. | 355/308 |
| 5,096,180 | A | * | 3/1992 | Nagaoka et al. | 271/110 |
| 5,455,667 | A | * | 10/1995 | Hiroi et al. | 355/309 |
| 5,535,627 | A | * | 7/1996 | Swanson et al. | 73/597 |
| 5,599,009 | A | * | 2/1997 | Mandel et al. | 270/58.09 |
| 5,622,364 | A | * | 4/1997 | Dutton et al. | 271/117 |
| 5,629,672 | A | * | 5/1997 | Brown et al. | 340/540 |
| 5,673,907 | A | * | 10/1997 | Rumsey et al. | 271/9.13 |
| 6,003,861 | A | * | 12/1999 | Iizumi et al. | 271/215 |
| 6,032,517 | A | * | 3/2000 | Reisig et al. | 73/78 |
| 6,140,662 | A | * | 10/2000 | Lim et al. | 250/559.38 |
| 6,278,270 | B1 | * | 8/2001 | Robles-Flores et al. | 324/207.21 |

FOREIGN PATENT DOCUMENTS

| | | | | |
|---|---|---|---|---|
| FR | 2786757 | | 6/2000 | |
| JP | 60229467 | A * | 11/1985 | H04N/1/00 |
| JP | 62096616 | A * | 10/1988 | H04N/1/00 |
| JP | 9208086 | | 8/1997 | |
| JP | 10315591 | | 12/1998 | |
| JP | 2001019229 | | 1/2001 | |
| JP | 2001114452 | | 4/2001 | |

* cited by examiner

*Primary Examiner*—Judy Nguyen
*Assistant Examiner*—Blaise Mouttet

(57) ABSTRACT

Printing systems and methods of operating printing systems are described. In but one embodiment, a printer comprises one or more processors, a print media tray for supporting a supply of print media, and a sensor operably associated with the print media tray. The sensor is configured to ascertain a measure associated with an amount of print media in the print media tray. The processor and the sensor are configured to ascertain, from the measure provided by the sensor, a number of remaining sheets of print media. In another embodiment, the sensor comprises a sonar sensor that is operably associated with a paper tray that holds a supply of paper.

32 Claims, 6 Drawing Sheets

SYSTEMS AND METHODS FOR AUTOMATICALLY DETECTING A NUMBER OF REMAINING SHEETS OF PRINT MEDIA

TECHNICAL FIELD

This invention relates to printing devices and methods of operating printing devices.

BACKGROUND

Printing devices typically use consumable items that must be replaced. There are different types of consumable items. For example, toner is a consumable item that is typically used in printers to effect printing on a print media such as paper. Toner typically comes in a toner cartridge with a limited amount of toner. When the toner becomes depleted, it must be replaced if printing is to continue. Other subsystems within printers are typically "consumables" because of their limited lifetime and the fact that they must be replaced.

In recent years, a great deal of work has been done in the area of consumables management. Managing consumables effectively can greatly increase the efficiency with which both the consumable and its associated device are used. As an example of some consumables management solutions, the reader is referred to the following U.S. Patents, all of which are incorporated by reference herein: U.S. Pat. Nos. 6,154,619, 6,128,448, 6,102,508, 6,019,449, 5,930,553, 5,812,156, 5,758,224, 5,682,140, and 5,491,540.

Print media, such as paper, is also a consumable that regularly needs to be replaced. Many printers come equipped with a sensor that indicates when the print media is out. In many models, this sensor comprises a small biased mechanical arm that reaches down to physically engage the print media. When the print media is exhausted, the mechanical arm is biased in a manner that indicates that the supply of print media is gone. Accordingly, a "media out" or "replace media" display is typically displayed on the printer for the user to see so that they can replace the print media.

While having this type of sensor is advantageous from the standpoint of notifying a user that they need to replace the print media all together, it stops short of providing a truly efficient consumables management solution. This sensor does not permit a user to ascertain whether there is enough print media for processing their print job. For example, how many times have you or someone you know sent a print job to a printer (for example, in an office setting), only to arrive at the printer to see a blinking "add print media" display, with only half the print job having been processed? This is inefficient and wastes not only the print job owner's time, but also the time of others who may have print jobs stacked up in the queue.

Accordingly, this invention arose out of concerns associated with providing improved printers and consumables management systems and methods for use in connection with printers.

SUMMARY

Printing systems and methods of operating printing systems are described. In one embodiment, a printer comprises one or more processors, a print media tray for supporting a supply of print media, and a sensor operably associated with the print media tray. The sensor is configured to ascertain a measure associated with an amount of print media in the print media tray. The processor and the sensor are configured to ascertain, from the measure provided by the sensor, a number of remaining sheets of print media.

In another embodiment, a printer comprises one or more processors, a paper tray for supporting a supply of paper, and a sonar sensor operably associated with the paper tray. The sonar sensor is configured to ascertain a measure associated with an amount of paper in the paper tray. The processor and the sonar sensor are configured to ascertain, from the measure provided by the sensor, a number of remaining sheets of paper.

In another embodiment, a printing system comprises multiple printers each of which comprising a paper tray for supporting a supply of paper, and means operably associated with the paper tray for automatically ascertaining a number of remaining sheets of paper in the paper tray. At least one host computer is configured to send print jobs to one or more of the multiple printers. A network links the host computer (s) and the multiple printers and provides a medium over which the print jobs can be sent to the printers.

In yet a further embodiment, a method of operating a printer comprises determining a measure associated with an amount of paper remaining in the printer, and calculating a number of remaining pages of paper from the measure.

In another embodiment, a method of operating a printer comprises receiving a print job with a printer and determining how many pages of paper are going to be needed to print the print job at the printer. The method automatically determines whether the printer has enough pages of paper to complete the print job, given the number of pages of paper that are needed for the print job.

BRIEF DESCRIPTION OF THE DRAWINGS

The same numbers are used throughout the drawings to reference like features and components.

DETAILED DESCRIPTION

Overview

The inventive techniques and systems described below permit printers to automatically determine the number of sheets of print media that remain for processing print jobs. When a print job is received, the printer can calculate whether it has enough sheets of print media to complete the job. If there are not enough sheets to complete the print job, the printer can generate a notification to the print job's owner so that the owner can take appropriate action such as seeking out another printer resource or replacing the paper.

Exemplary Printer System

Figure 1:
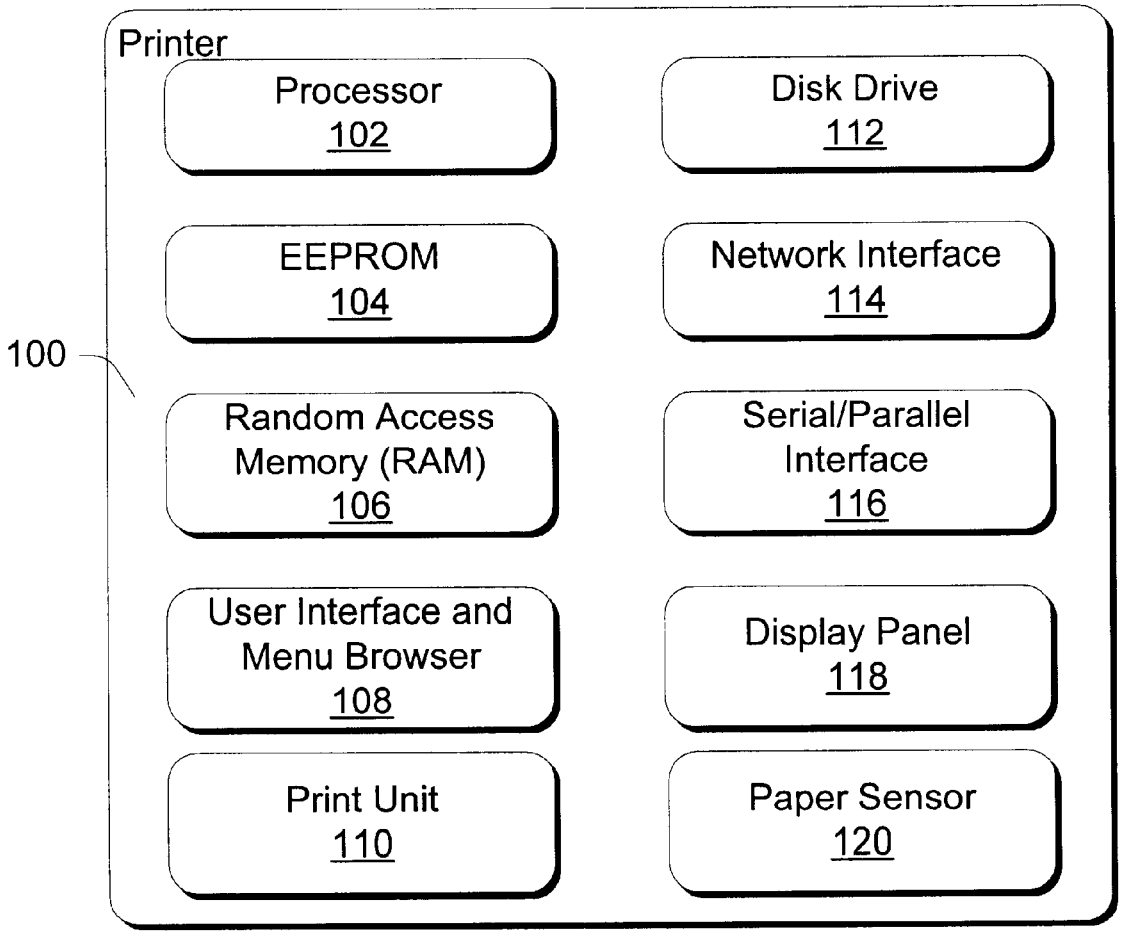
FIG. 1 is a block diagram of an exemplary printer in accordance with one embodiment.

For purposes of understanding various structures associated with an exemplary printing device, consider FIG. 1.

FIG. 1 is a block diagram showing exemplary components of a printing device in the form of a printer 100 in accordance with one embodiment. It will be appreciated and understood that the illustrated printing device constitutes but one exemplary printing device and is not intended to be limiting in any way. Accordingly, other printing devices can be used in connection with the inventive techniques and systems described herein. These other printing devices can have components that are different from those described immediately below.

Printer 100 includes a processor 102, an electrically erasable programmable read-only memory (EEPROM) 104, and a random access memory (RAM) 106. Processor 102 processes various instructions necessary to operate the printer 100 and communicate with other devices. EEPROM 104 and RAM 106 store various information such as configuration information, fonts, templates, data being printed, and menu structure information. Although not shown in FIG. 1, a particular printer may also contain a ROM (non-erasable) in place of or in addition to EEPROM 104. Furthermore, a printer may alternatively contain a flash memory device in place of or in addition to EEPROM 104.

Printer 100 can also include a disk drive 112, a network interface 114, and a serial/parallel interface 116. Disk drive 112 provides additional storage for data being printed or other information used by the printer 100. Although both RAM 106 and disk drive 112 are illustrated in FIG. 1, a particular printer may contain either RAM 106 or disk drive 112, depending on the storage needs of the printer. For example, an inexpensive printer may contain a small amount of RAM 106 and no disk drive 112, thereby reducing the manufacturing cost of the printer. Network interface 114 provides a connection between printer 100 and a data communication network. Network interface 114 allows devices coupled to a common data communication network to send print jobs, menu data, and other information to printer 100 via the network. Similarly, serial/parallel interface 116 provides a data communication path directly between printer 100 and another device, such as a workstation, server, or other computing device. Although the printer 100 shown in FIG. 1 has two interfaces (network interface 114 and serial/parallel interface 116), a particular printer may only contain one interface.

Printer 100 also includes a print unit 110 that includes mechanisms that are arranged to selectively apply ink (e.g., liquid ink, toner, etc.) to a print media (e.g., paper, plastic, fabric, etc.) in accordance with print data within a print job. Thus, for example, print unit 110 can include a conventional laser printing mechanism that selectively causes toner to be applied to an intermediate surface of a drum or belt. The intermediate surface can then be brought within close proximity of a print media in a manner that causes the toner to be transferred to the print media in a controlled fashion. The toner on the print media can then be more permanently fixed to the print media, for example, by selectively applying thermal energy to the toner. Print unit 110 can also be configured to support duplex printing, for example, by selectively flipping or turning the print media as required to print on both sides. Those skilled in the art will recognize that there are many different types of print units available, and that for the purposes of the present invention print unit 110 can include any of these various types.

Printer 100 also contains a user interface/menu browser 108 and a display panel 118. User interface/menu browser 108 allows the user of the printer to navigate the printer's menu structure. User interface 108 may be a series of buttons, switches or other indicators that are manipulated by the user of the printer. Display panel 118 is a graphical display that provides information regarding the status of the printer and the current options available through the menu structure.

Printer 100 also includes a paper sensor 120. The paper sensor 120 has characteristics that permit it to ascertain a measure that is associated with an amount of print media that remains in the printer 100. This measure can be an actual value that equals the number of sheets that remain in the printer. Alternately, the measure can be a measure that can be further processed by the processor 102 to provide an accurate value that describes the number of sheets of print media that remain in the printer.

In the discussion above and below, certain aspects of the described embodiments can be implemented in terms of software instructions that reside on a computer-readable media. These instructions, when executed by a computer or processor, are configured to implemented a designed functionality. This functionality will be described in this document in flow chart form.

Exemplary Host Computer

Figure 2:
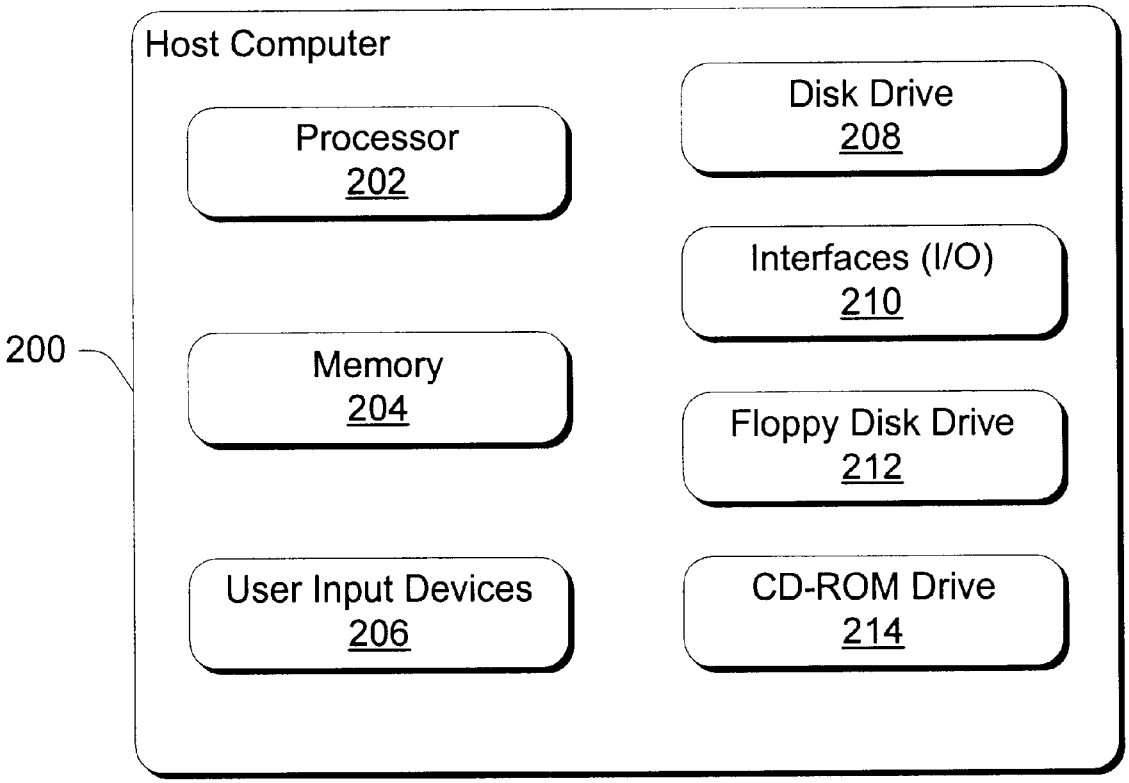
FIG. 2 is a block diagram of an exemplary host computer in accordance with one embodiment.

For purposes of understanding various structures associated with an exemplary host computer, consider FIG. 2.

FIG. 2 is a block diagram showing exemplary components of a host computer 200. Host computer 200 includes a processor 202, a memory 204 (such as ROM and RAM), user input devices 206, a disk drive 208, interfaces 210 for inputting and outputting data, a floppy disk drive 212, and a CD-ROM drive 214. Processor 202 performs various instructions to control the operation of computer 200. Memory 204, disk drive 208, and floppy disk drive 212, and CD-ROM drive 214 provide data storage mechanisms. User input devices 206 include a keyboard, mouse, pointing device, or other mechanism for inputting information to computer 200. Interfaces 210 provide a mechanism for computer 200 to communicate with other devices.

First Embodiment (Wireless Sensor)

Figure 3:
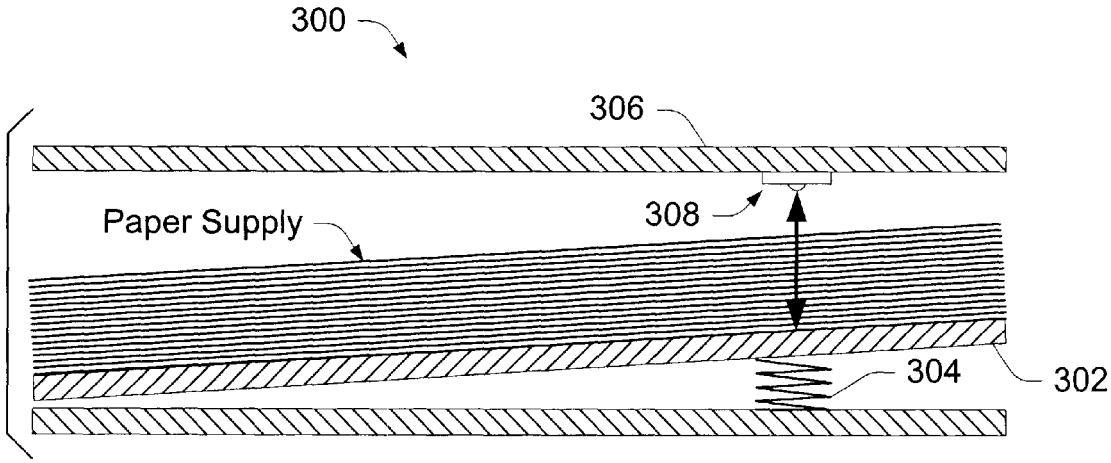
FIG. 3 is a side sectional diagram of an exemplary paper sensing system in accordance with one embodiment.

FIG. 3 shows a first embodiment 300 of a sensing device that is configured to enable a determination to be made regarding an amount of remaining print media. In this example, the print media comprises paper and the amount of remaining paper comprises the number of sheets of paper that remain in the printer.

In this particular example, embodiment 300 comprises a paper tray 302 that supports a supply of paper. The paper tray is configured for insertion into and retention by a printer. Exemplary printers include, without limitation, laser printers and ink jet printers. Exemplary laser printers are described in U.S. Pat. Nos. 6,057,867, 6,034,711, and 6,018,400, the disclosures of which are incorporated by reference herein. Exemplary ink jet printers are described in U.S. Pat. Nos. 6,155,680, 6,153,114, and 6,126,265, the disclosures of which are incorporated by reference herein.

It is to be appreciated and understood that while the inventive techniques and systems are described in the context of printers such as laser and ink jet printers, the inventive principles described herein are not to be so limited. Accordingly, the inventive techniques and systems can be applied in a wide variety of other printers or printing devices that are not necessarily laser or ink jet printers.

Typically, paper tray 302 is biased by a bias mechanism, such as spring 304, such that the paper is disposed in a position where it can be picked up and processed by the printer. A support structure 306 is provided adjacent and spaced from paper tray 302. The support structure can comprise any suitable support structure.

In accordance with one embodiment, a wireless sensor 308 is provided and is configured to wirelessly ascertain a measure that is associated with an amount of remaining paper. This measure can then be processed by the printer's processor to ascertain the number of pieces of paper that remain in the paper tray. In this particular example, the wireless sensor comprises a sonar sensor that is configured to project a sonar signal outwardly therefrom and in a direction generally toward paper tray 302. The sonar signal is reflected by the paper tray and provides a measure of the distance between the sonar sensor and the paper tray. From there, as described in detail below, the amount of paper that remains in the paper tray can be ascertained. Exemplary sonar sensors and the principles upon which they operate are described in U.S. Pat. No. 5,930,200, the disclosure of which is incorporated by reference herein. Additionally, sonar sensors and the principles upon which they work are discussed Stergiopoulos, *Advanced Signal Processing Handbook. Theory and Implementation for Radar, Sonar, and Medical Imaging Real Time Systems,* Lewis Publishers, Inc.

Figure 4:
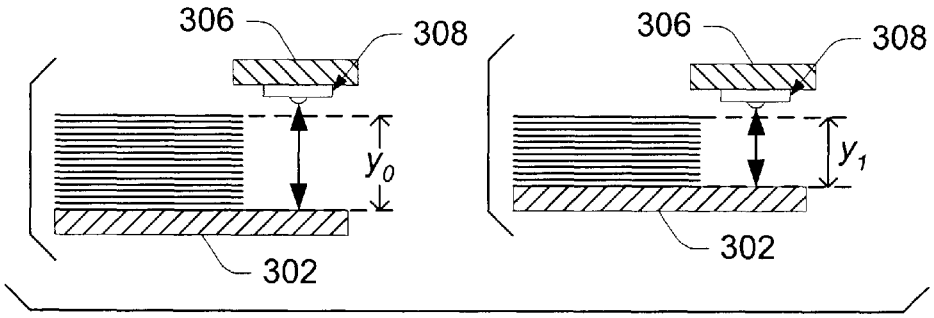
FIG. 4 is a diagram of the FIG. 3 paper sensing system.

FIG. 4 shows sensor 308 in a little more detail and illustrate how the amount of remaining paper can be calculated.

When a paper stack is first inserted into and supported by the paper tray, the paper stack can initially contain an unknown number of pages. Because paper can come in different thicknesses, stack heights that are the same as between different types of paper can have different numbers of individual sheets. In the described example, sensor 308 is configured to ascertain an initial distance measure relative to the paper tray 302. So, for example, when a paper stack is first inserted into the paper tray, sensor 308 can ascertain a distance measure $y_0$. This distance measure is calibrated so that $y_0$ pertains to the thickness of the paper stack. When the first piece of paper is picked and fed into the printer for printing, this distance measure changes by a small amount that is equal to the thickness of a piece of paper. If the new distance measure is $y_1$, then the thickness of the piece of paper that was picked is $(y_0-y_1)$. Using this measure, one can easily calculate the number of paper sheets that remain. Specifically, given that the new distance measure is $y_l$ and given that each piece of paper has a thickness $(y_0-y_1)$, the number of remaining sheets of paper can be calculated as follows:

$$\text{Remaining sheets}=y_1/(y_0-y_1)$$

This can be generalized for the case where a print job has progressed through a number of sheets of paper. Thus, generally at any time t, sensor 308 will be able to ascertain a distance measure $y_t$. Accordingly, the amount of remaining paper can be ascertained as follows:

$$\text{Remaining sheets}=y_t/(y_0-y_l)$$

It should be noted that the above example is given in the context of determining the remaining amount of paper, given that a single piece of paper is removed from the paper tray. This can also be extended to determining the remaining amount of paper given that multiple pieces of paper have been removed. Specifically, by measuring the amount of paper that is removed over time and averaging over a number of pages, the amount of pages remaining can be calculated with more precision.

In the illustrated example, the processing or calculation steps that take place are performed by the printer's own processor. Additionally, the printer's memory resources can be utilized to store distance measures such that if the printer is powered down and then powered up with a different amount of paper in the paper tray, the system can determine this and thus calculate new parameters associated with determining how much paper remains.

Any suitable wireless sensor can be used to implement sensor 308. In the example above, a sonar sensor was described. Other wireless sensors such as Infrared (IR) sensors, laser beam sensors and the like can be utilized. Such sensors should be desirably sensitive so that they can sense the differential in distance measures between the paper tray 302 and the sensor when a single piece of paper is removed.

Second Embodiment (Electromagnetic sensor)

In another embodiment, the sensor is implemented as an electromagnetic sensor that is configured to provide distance measures in accordance with principles of electromagnetism.

Figure 5:
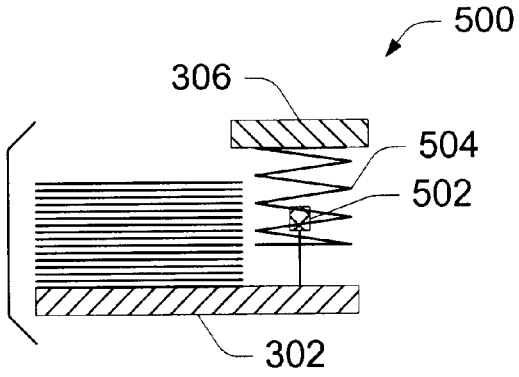
FIG. 5 is a side sectional diagram of another exemplary paper sensing system in accordance with one embodiment.

FIG. 5 shows one such electromagnetic sensor generally at 500. The sensor includes a magnet/coil pair comprising magnet 502 and coil 504. The magnet 502 can be mounted on paper tray 302 for movement as the tray progresses upward and downward. The coil 504 can be fixed on structure 306. The magnet 502 can be received inside of coil 504 for movement in accordance with the paper tray. As the magnet moves up and down within the coil, electromagnetic forces can be used to ascertain a distance measure that, in turn, gives an indication of the remaining paper stack height. Given the remaining paper stack height, the number of sheets of paper remaining in the paper tray can be calculated as described above. Any suitable electromagnetic sensor can be utilized and will be known by those of skill in the art. One exemplary sensor that embodies principles that can be utilized in the present example is described in U.S. Pat. No. 6,016,707, the disclosure of which is incorporated by reference herein.

Third Embodiment (Capacitive Sensor)

In another embodiment, the sensor is implemented as a capacitive sensor that is configured to provide distance measures in accordance with principles of capacitance.

Figure 6:
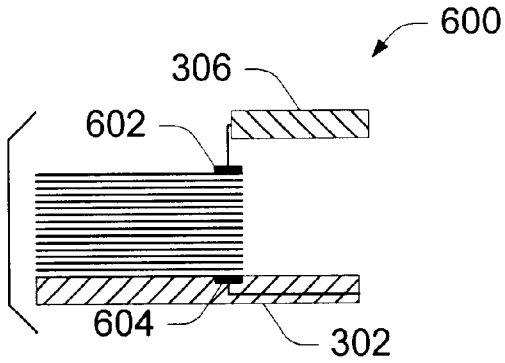
FIG. 6 is a side sectional diagram of another exemplary paper sensing system in accordance with one embodiment.

FIG. 6 shows one such capacitive sensor generally at 600. Sensor 600 includes first and second capacitor plates 602, 604. The capacitor plates can be formed from any suitable conductive material. In this example, capacitor plate 602 is mounted on structure 306, while capacitor plate 604 is mounted on paper tray 302. The paper stack can be utilized as a dielectric element for the capacitor. Here, the distance between the capacitor plates changes as a paper is added to or removed from the paper tray. As this capacitance changes, the capacitance values can be mapped to distance measures which give an indication of the remaining stack height. Given the stack height and thickness of an individual paper sheet in the stack height, the remaining number of sheets of paper can be calculated as described above. The theories under which capacitive systems such as the one described above work are known. For additional background information on such systems as well as their theory of operation, the reader is referred to the following U.S. Patents, the disclosures of which are incorporated by reference herein: U.S. Pat. Nos. 5,587,530, and 5,488,865.

Fourth Embodiment (Mechanical Sensor)

In another embodiment, the sensor is implemented as a mechanical sensor that is configured to provide distance measures in accordance with mechanical principles. Any suitable mechanical sensor can be utilized. For example, a caliper-like sensor can be used to ascertain a remaining amount of paper.

Figure 7:
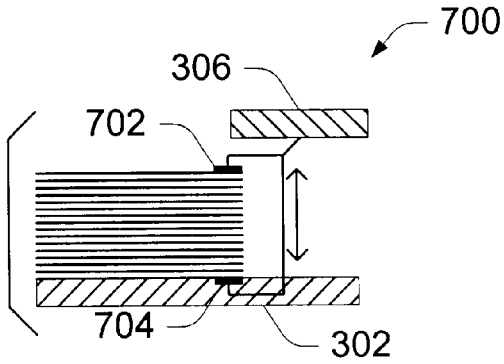
FIG. 7 is a side sectional diagram of another exemplary paper sensing system in accordance with one embodiment.

FIG. 7 shows one such mechanical sensor generally at 700 that includes a pair of arms 702, 704 that physically engage a paper supply. The arms are advantageously spring-biased so that they maintain physical contact with the paper. As the paper supply is used, the sensor is calibrated to ascertain the amount of paper remaining. Given that the system knows the thickness of a single piece of paper, the remaining amount of paper can be used to ascertain a measure of how many sheets of paper are left in the supply.

Exemplary Method

Figure 8:
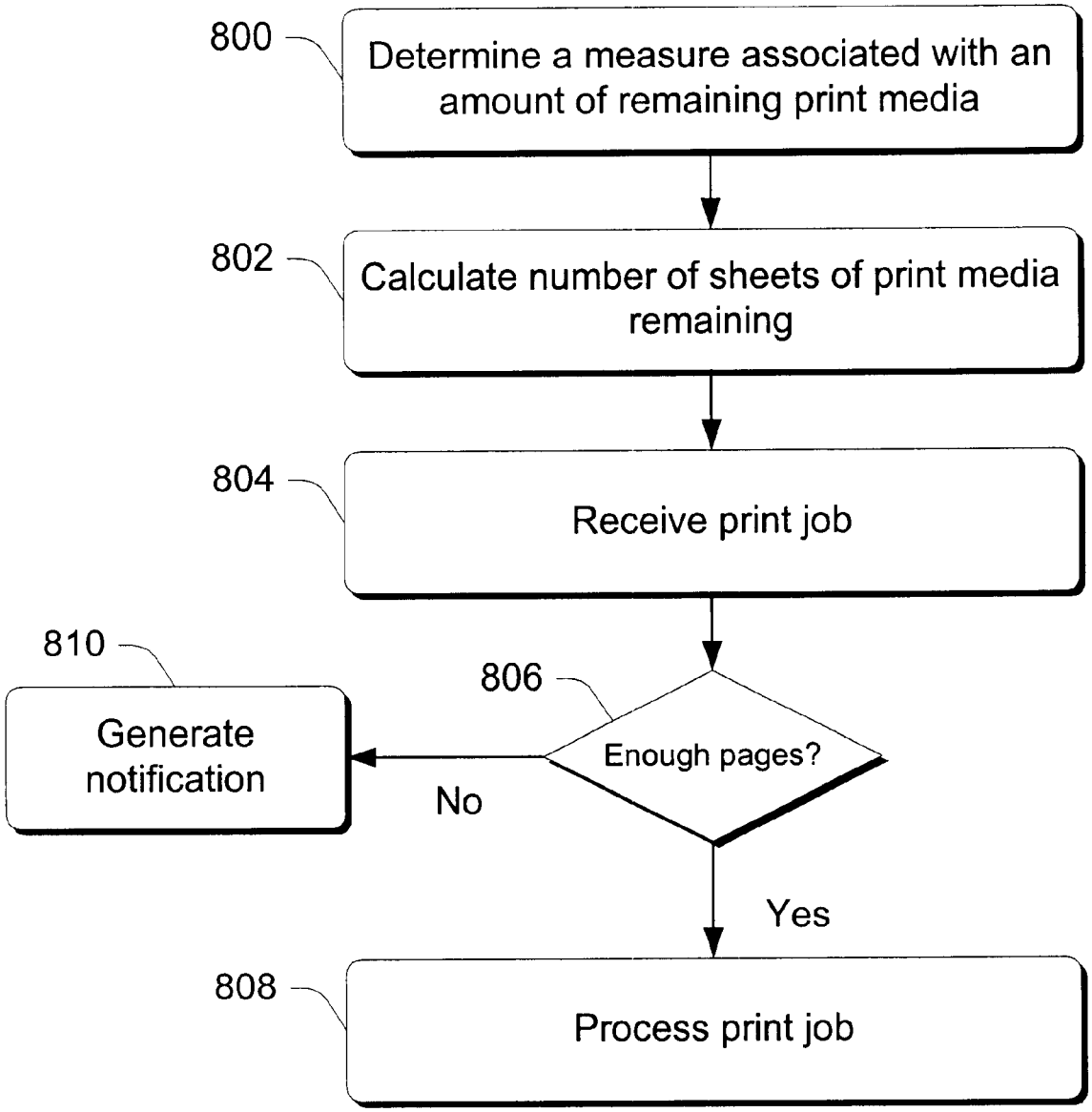
FIG. 8 is a flow diagram describing steps in a method in accordance with one embodiment.

FIG. 8 is a flow diagram that describes steps in a method in accordance with one embodiment.

Step 800 determines a measure associated with an amount of remaining paper. This step can be implemented in any suitable way using any suitable sensor. Advantageously, the step can be implemented automatically. For example, many different types of sensors are described above that are capable of measuring a remaining amount of paper. Step 802 calculates a number of remaining pages using the measure provided by step 800. One example of how this can be done is given above. This step is preferably implemented in the printer and can be performed by the printer's processor or other firmware that is present in the printer. Step 804 receives a print job. Typically information associated with the print job describes how many pages the print job is going to use. Step 806 determines whether there are enough pages in the printer's supply to adequately print the print job. This step is implemented by a comparison step. Specifically, the printer compares the number of pages that are needed for a print job with the number of pages that remain in the printer (step 802). If enough pages remain in the printer to complete the print job, step 808 processes the print job as usual. If, however, there are not enough pages in the printer to complete the print job, then step 810 generates a notification. This notification can be any suitable notification that can be generated and sent to the owner of the print job. The notification can inform the print job owner that there is not enough print media to complete their print job. At this point, the print job owner can then either add print media to the printer, or seek out another resource upon which to print their print job.

Figure 9:
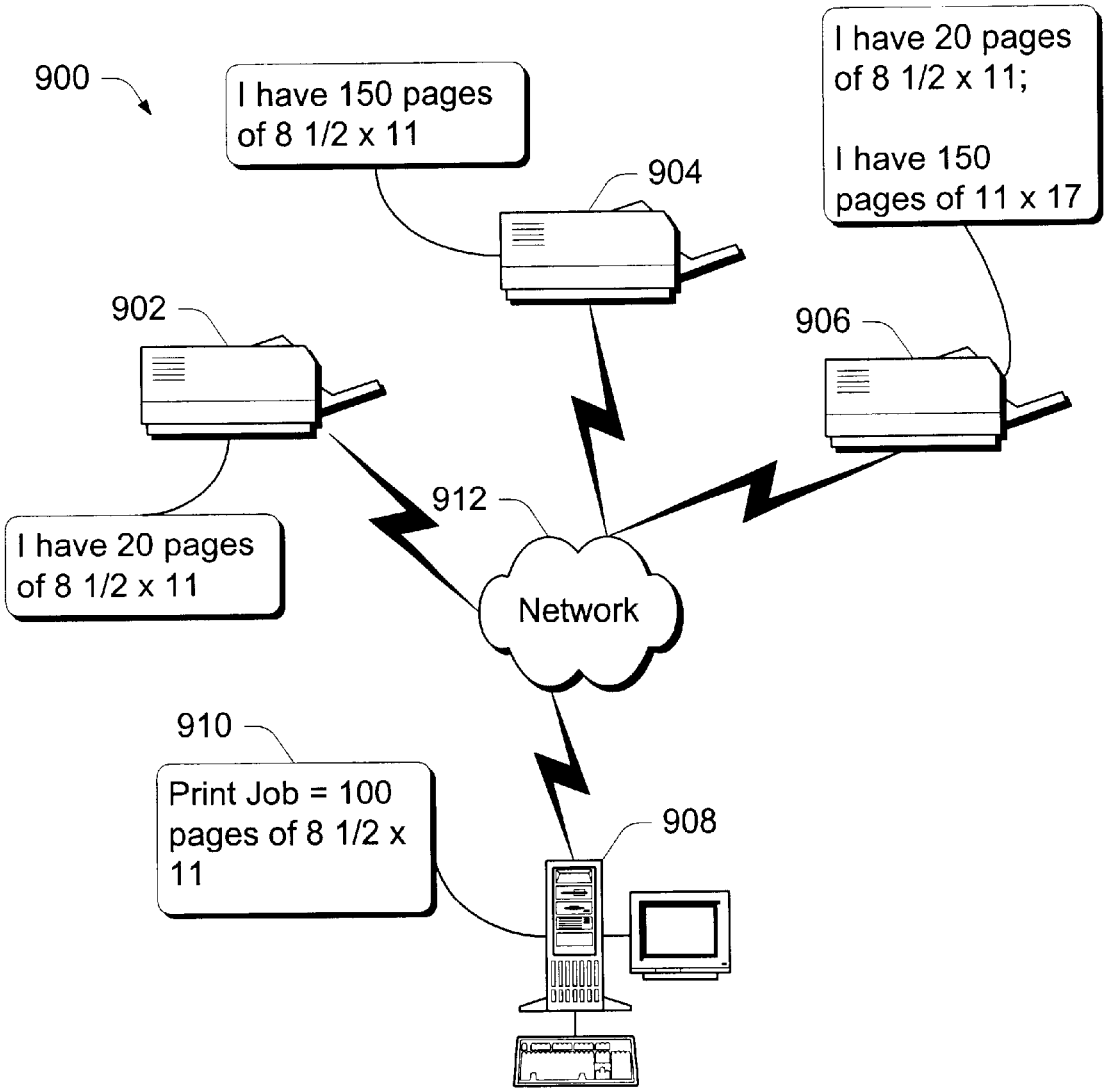
FIG. 9 is a block diagram of a system in accordance with one embodiment.

FIG. 9 shows one exemplary system 900 in which the inventive techniques and systems can be employed. System 900 has multiple printers, three of which being shown at 902, 904, 906. Each of the printers is configured with a sensor for automatically detecting an amount of paper remaining, and software for calculating the amount of remaining paper in the printer. A client computer 908 generates a print job 910 that is then sent via a network 912 to a first of the printers—in this example, printer 902. When printer 902 receives the print job, it ascertains how many pages the print job needs. It can also ascertain the type of print media. For example, many printers can be loaded with different print media at any one time. For example, some printers can be loaded with 8½×11 as well as 11×17, each in different printer trays. When the print job is received and processed by the printer, the printer then determines whether it has enough pages left to complete the print job. In this present case, printer 902 only has 20 pages of the required media for the print job. Accordingly, the printer can generate a notification to the user of the client computer informing them that there is not enough print media to complete their print job. The user can then search out other network resources to complete their print job. For example, in this case, printer 904 has adequate resources to complete the print job. While printer 906 has adequate 11×17 media to process the print job, it only has 20 8½×11 pages.

Conclusion

The inventive techniques and systems provide an opportunity for consumables management in the area of print media. The number of remaining pages of print media can be automatically calculated so that, at any one time, printer resources are knowledgeable about the amount of print media they contain. This knowledge can be used to evaluate print jobs as they are received so that print job owners can be informed if it appears that a printer is going to be unable to adequately complete a print job. This results in more efficient management of printer resources and user time. In addition, the described embodiments are advantageous from the standpoint of eliminating other paper sensing mechanisms in the printer. Specifically, most if not all printers have a paper sensor that indicates whether there is paper in the paper tray. By incorporating the inventive embodiments described above, these other types of printer sensors (i.e. ones that simply indicate whether or not there is paper in the paper tray) can be eliminated.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

I claim:

1. A printer comprising:

one or more processors;

a print media tray for supporting a supply of print media;

a sensor operably associated with the print media tray and configured to non-capacitatively ascertain a direct measure of a direct distance between the sensor and the print media tray associated with an amount of print media in the print media tray without physically engaging the print media; and the one or more processors and the sensor being configured to ascertain, from changes in said direct measure of said direct distance, a number of remaining sheets of print media.

2. The printer of claim 1, wherein the printer is configured to:

receive a print job; and determine if there are enough sheets of print media in the print media tray to complete the print job.

3. The printer of claim 2, wherein the printer is configured to generate a notification in an event that there are not enough sheets of print media to complete the print job.

4. The printer of claim 1, wherein said sensor comprises a wireless sensor that wirelessly ascertains said measure.

5. The printer of claim 1, wherein said sensor comprises a sonar sensor that produces a sonar signal and receives a reflected signal to ascertain said measure.

6. The printer of claim 1, wherein said sensor comprises an infrared sensor that ascertains said measure.

7. The printer of claim 1, wherein said sensor comprises a laser beam sensor that ascertains said measure.

8. The printer of claim 1, wherein said sensor comprises an electromagnetic sensor that ascertains said measure.

9. The printer of claim 8, wherein said sensor comprises a magnet/coil pair.

10. The printer of claim 1, wherein said printer comprises a laser printer.

11. The printer of claim 1, wherein said printer comprises an ink jet printer.

12. A printer comprising:

one or more processors;

a paper tray for supporting a supply of paper;

a sonar sensor operably associated with the paper tray and configured to ascertain a direct measure of a direct distance between the sonar sensor and the paper tray and associated with an amount of paper in the paper tray; and the one or more processors and the sonar sensor being configured to ascertain, from changes in said direct measure of said direct distance, a number of remaining sheets of paper.

13. The printer of claim 12, wherein said sonar sensor (1) determines an initial measure associated with an initial amount of paper, and (2) determines at least one additional measure associated with the initial amount of paper less one or more sheets that have been picked for printing.

14. The printer of claim 13, wherein said one or more processors determine a thickness of an individual piece of paper by subtracting an additional measure from the initial measure.

15. The printer of claim 14, wherein said one or more processors determines the number of remaining sheets of paper by dividing an additional measure by the thickness of an individual piece of paper.

16. The printer of claim 12, further comprising printer memory configured to store a measure associated with an amount of paper in the printer when the printer is powered down.

17. The printer of claim 16, wherein said sonar sensor determines an initial measure associated with an initial amount of paper when the printer is powered up, the printer comparing that initial measure with the stored measure, and ascertaining whether there is a different number of paper sheets in the printer.

18. The printer of claim 17, wherein if there is a different number of sheets of paper when the printer is powered up, the one or more processors calculates one or more new parameters associated with determining how much paper remains.

19. A printing system comprising:

multiple printers each of which comprising a paper tray for supporting a supply of paper, and means operably associated with the paper tray for automatically ascertaining a direct measure of a direct distance between said means and the paper tray and associated with a number of remaining sheets of paper in the paper tray without physically engaging any of the sheets of paper in the paper tray, and calculating, from differences in said direct distance, a number of remaining sheets of paper;

at least one host computer that is configured to send print jobs to one or more multiple printers; and a network linking the one host computer and the multiple printers and over which the print jobs can be sent.

20. The printing system of claim 19, wherein said means comprise wireless means.

21. The printing system of claim 19, wherein said means comprise electromagnetic means.

22. The printing system of claim 19, wherein the individual printers are configured to generate a notification in an event that they cannot complete a print job given the number of remaining sheets.

23. A method of operating a printer comprising:

non-capacitatively determining a direct measure of a direct distance between a sensor and a printer paper tray, said direct distance being associated with an amount of paper remaining in a printer, said determining being performed without physically engaging the paper; and calculating, from changes in said direct distance, a number of remaining pages of paper.

24. The method of claim 23, wherein said determining comprises automatically determining said measure using a sonar sensor.

25. The method of claim 23, wherein said determining comprises automatically determining said measure using a wireless sensor.

26. The method of claim 23, wherein said determining comprises automatically determining said measure using an infrared sensor.

27. The method of claim 23, wherein said determining comprises automatically determining said measure using an electromagnetic sensor.

28. A method of operating a printer comprising:

receiving a print job with a printer;

determining how many pages of paper are going to be needed to print the print job at the printer;

automatically determining whether the printer has enough pages of paper to complete the print job given the number of pages of paper that are needed for the print job, said automatically determining comprising non-capacitatively ascertaining a direct measure of a direct distance associated with the number of pages of paper in the printer in a manner in which the paper is not physically engaged, and from changes in said direct distance ascertaining the number of pages.

29. The method of claim 28 further comprising generating a notification with the printer if there are not enough pages in the printer to complete the print job.

30. The method of claim 28, wherein said automatically determining comprises:

using a wireless sensor to ascertain a measure associated with an amount of paper in the printer; and processing said measure to ascertain said number of pages.

31. The method of claim 28, wherein said automatically determining comprises:

using a sonar sensor to ascertain a measure associated with an amount of paper in the printer; and processing said measure to ascertain said number of pages.

32. The method of claim 28, wherein said automatically determining comprises:

using an electromagnetic sensor to ascertain a measure associated with an amount of paper in the printer; and processing said measure to ascertain said number of pages.

* * * * *